US005328895A

United States Patent [19]

Ito et al.

[11] Patent Number: 5,328,895

[45] Date of Patent: Jul. 12, 1994

[54] INK RIBBON FOR THERMAL TRANSFER

[75] Inventors: Kengo Ito; Hideki Hirano, both of Kanagawa, Japan

[73] Assignee: Sony Corporation, Tokyo, Japan

[21] Appl. No.: 913,968

[22] Filed: Jul. 17, 1992

[30] Foreign Application Priority Data

Jul. 19, 1991 [JP] Japan ..... 3-203752

[51] Int. Cl.[5] ..... B41M 5/035; B41M 5/38

[52] U.S. Cl. ..... 503/227; 428/195; 428/913; 428/914

[58] Field of Search ..... 503/227; 428/195, 211, 428/913, 914

[56] References Cited

U.S. PATENT DOCUMENTS 5,019,452 5/1991 Watanabe et al. ..... 428/422

5,064,807 11/1991 Yoshida et al. ..... 503/227

FOREIGN PATENT DOCUMENTS 02243377 9/1990 Japan .

*Primary Examiner*—Patrick J. Ryan

*Assistant Examiner*—William A. Krynski

*Attorney, Agent, or Firm*—Hill, Steadman & Simpson

[57] ABSTRACT

There is disclosed an ink ribbon for forming a dye image on a photographic paper by the thermal transfer system. An ink layer of the ink ribbon includes anion dye in which paired ion is exchanged for hydrophobic organic cation and hydrophobic polymer. As anion dye, phthalocyanine system anion dye is used. The hydrophobic organic cation is selected from aliphatic amine, aliphatic quaternary ammonium ion, aromatic quaternary ammonium ion, and heterocyclic quaternary ammonium ion. The rate of anion dye to the total quantity of the anion dye and the hydrophobic polymer is 10 to 90% by weight.

2 Claims, 1 Drawing Sheet

INK RIBBON FOR THERMAL TRANSFER

BACKGROUND OF THE INVENTION

1. Field of the Invention

This invention relates to an ink ribbon for thermal transfer used for an image formation method for forming a dye image on a photographic or printing paper by the thermal transfer system.

2. Description of the Prior Art

In order to print out an image photographed by, e.g., an electronic still camera, etc. on a photographic paper in the same manner as in the silver salt system photograph, an attempt has been made to form an image by the thermal transfer system.

In such a thermal transfer system, an ink ribbon is caused to be in contact with a photographic paper on which an image receiving layer consisting of hydrophobic high molecular substance or polymer such as polyester, etc. is formed on a transferred material such as a synthetic paper, etc. to heat the ink ribbon by means of a thermal head, etc. to allow dye included in this ink ribbon to be transferred to the image receiving layer of the photographic paper.

The ink ribbon can be obtained by dissolving dye into an organic solvent together with a binder high molecular substance to coat it on a base. Hitherto, as the dye of this ink ribbon, a disperse dye has been used mainly with a view to ensuring practical sensitivity.

However, in the case where an ink ribbon including such disperse dye is used, it is pointed out that an image formed by the thermal transfer system is remarkably inferior to that of the silver salt photograph in respect of conservative stability, particularly light resistance.

On the other hand, there has been also proposed a method of using, in place of the disperse dye, phthalocyanine anion dye which can obtain excellent light resistance as compared to that of the disperse dye.

However, since phthalocyanine includes a hydrophilic group or radical in the molecule, it exhibits poor or unsatisfactory compatibility with the binder high molecular substance. Accordingly, it is difficult to form a practical image.

OBJECT AND SUMMARY OF THE INVENTION

An object of this invention is to provide an ink ribbon for thermal transfer, which can carry out satisfactory image formation, an which can ensure light resistance comparable to that of the silver salt system photographic image.

As the result of the fact that the inventors of this application energetically conducted studies with a view to attaining the above-described object, they found that compatibility between phthalocyanine and binder high molecular substance is improved by exchanging the paired ion of phthalocyanine system anion dye for an organic cation having strong hydrophobic properties, whereby a satisfactory image is formed, and completed this invention on the basis of this finding.

Namely, this invention is characterized in that the anion dye in which the paired ion is exchanged for a hydrophobic organic cation is included at a rate of 10 to 90% by weight in the hydrophobic polymer.

By exchanging the paired ion of anion dye for the hydrophobic organic cation, compatibility between the anion dye and binder high molecular substance serving as the hydrophobic polymer is improved. Thus, a satisfactory image is obtained.

Accordingly, it is possible to use, in the same manner as in the case of the disperse dye, the phthalocyanine system anion dye which was conventionally considered to be improper as the dye of the ink ribbon of the thermal transfer system. If the phthalocyanine system anion dye is used, it is possible to obtain an ink ribbon that is essentially excellent in preservative stability, particularly light resistance.

In addition, the dye included in an ink ribbon for thermal transfer of this invention has good or excellent compatibility with the hydrophobic polymer. It is possible to form a satisfactory image even on a photographic paper in which the polyester resin having strong hydrophobic properties is used as an image receiving layer.

DETAILED DESCRIPTION OF THE INVENTION

Figure 1:
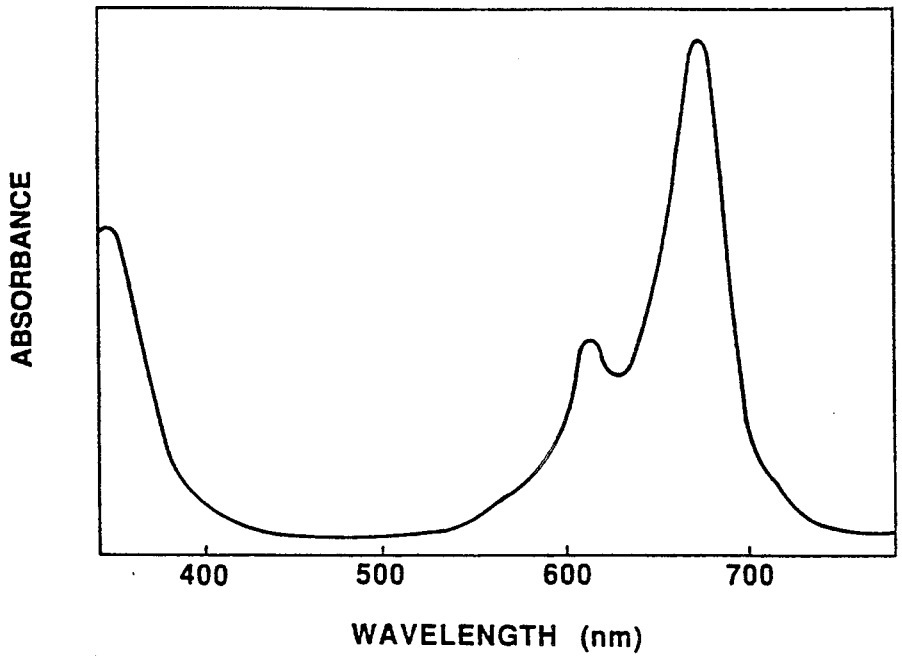
FIG. 1 is a characteristic diagram showing a visible absorption spectrum of an ink ribbon for thermal transfer to which this invention is applied.

An ink ribbon for thermal transfer of this invention is obtained by exchanging the paired ion of anion dye (ordinarily alkali metal ion) for an organic cation having strong hydrophobic properties. An insoluble or slightly soluble salt was prepared in water, thereafter dissolving the salt into an organic solvent together with a binder high molecular substance functioning as a hydrophobic polymer. A coating solution is, thereby, provided which is coated or painted on a support film followed by a drying process, thereby forming a dye transfer layer.

As the anion dye in the present invention, the phthalocyanine system anion dye has excellent light resistance and is, thus, suitable.

As the phthalocyanine system anion dye, there can be used dye obtained by adding a sulfonic group to an aromatic ring of phthalocyanine to allow it to be hydrophilic (center metal is transition metal such as Cu, Zn, Fe, Ni or Co, etc. and the number of sulfonic groups can be 1 to 4).

If the paired ion of this anion dye is exchanged for an organic cation having strong hydrophobic properties, compatibility with the hydrophobic polymer is remarkably improved. With respect to an organic cation having strong hydrophobic properties, a cation ion surface active agent can be generally used. For example, aliphatic amine salt and its quaternary ammonium salt, aromatic quaternary ammonium salt, or heterocyclic quaternary ammonium salt, etc. can be used.

Aliphatic amine salt and its quaternary ammonium salt are compounds having structural formulas (1) and (2) indicated below:

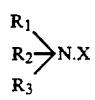

(1)

($R_1$ indicates an alkyl group having 12 to 18 carbon atoms, and $R_2$ and $R_3$ indicate a hydrogen group or a methyl group. Further, X indicates organic acid or inorganic acid.)

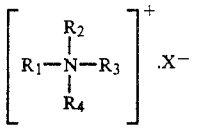

(2)

($R_1$ to $R_4$ indicates an alkyl group wherein at least one of them indicates a long chain alkyl group having the number of 4 to 20. Further, X indicates Cl, Br or I.)

Aromatic quaternary ammonium salt is a compound having a structural formula (3) indicated below. In actual terms, there are enumerated a benzalkonium salt indicated by the following formula (4), and benzethonium chloride indicated by the following formula (5), etc.

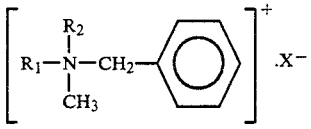

(3)

($R_1$ indicates a hydrocarbon group having the number of carbons of 12 to 18, and $R_2$ indicates methyl group or hydrocarbon having the number of carbons of 12 to 18. Further, X indicates Cl, Br or I.)

Benzalkonium salt

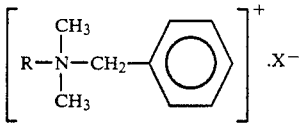

(4)

(R indicates a hydrocarbon group having the number of 12 to 18, and X indicates Cl or Br.)

Benzethonium chloride

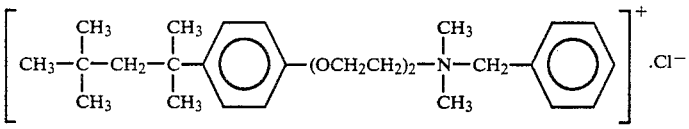

(5)

Further, as heterocyclic quaternary ammonium salt, there are enumerated pyridinium salt indicated by the following formula (6), a compound indicated by the following formula (7), and imidazolinium salt indicated by the following formula (8), etc.

Pyridinium salt

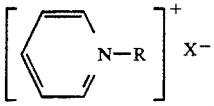

(6)

(R indicates hydrocarbon group having the number of 12 to 18, and X indicates Cl or Br.)

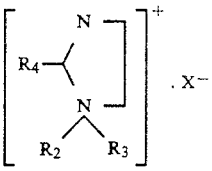

(7)

($R_1$ indicates hydrocarbon group having the number of 12 to 18, $R_2$ indicates

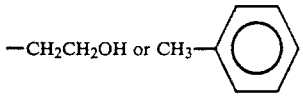

, etc. Further, X indicates Cl, Br or I.)

Imidazolinium salt

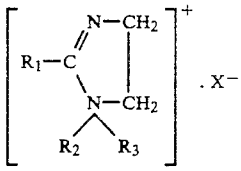

(8)

($R_1$ indicates hydrogen group or hydrocarbon having the number of 1 to 4, $R_2$ indicates hydrocarbon group having the number of 12 to 24, and $R_3$ indicates hydrocarbon group having the number of carbons of 1 to 5. Further, X indicates Cl or Br.)

If the hydrophilic radical (paired ion) existing in the molecule of the anion dye is ion-exchanged by such organic cation having strong hydrophobic properties, compatibility between the anion dye and binder high molecular substance is improved. Accordingly, by dissolving, into the binder high molecular substance, the anion dye in which the paired ion is exchanged for the organic cation at a fixed rate to coat it on a base, an ink ribbon having excellent light resistance and the formation of a satisfactory image can be obtained.

The content of the anion dye is set to 10 to 90% by weight with respect to the hydrophobic polymer. If the content of anion dye is greater than the values in the above-mentioned range, because the anion dye cannot be dispersed into the hydrophobic polymer, it is impossible to form a uniform ink ribbon. In contrast, if the content of anion dye is less than the values in the above-mentioned range, the sensitivity of an image at the time of thermal transfer fail to be sufficiently ensured.

While this invention will now be described in accordance with practical embodiments, this invention is not limited to these embodiments.

Embodiment 1

1 g of copper phthalocyanine tetrasulfonic sodium salt (product by Kodak Inc.) was dissolved into water of 50 cc to further drop, into this aqueous solution, a mixture solution of 400 cc in which water of tetradecil bromide ammonium salt of 0.67% by weight and ethanol were mixed at the same quantity. As a result, a solid component was separated on the liquid surface. After the liquid phase by filtrate was removed, this solid component was extracted by toluene. After solvent was removed by distillation under a decompressed state, the solid component was dried under a decompressed pressure at a temperature of 50° C. Thus, a viscous amorphous solid of about 1 g was obtained.

The dye thus obtained was dissolved into methyl ethyl ketone by the composition described below together with polystyrene-acrylonitrile copolymer which was used as the binder high molecular substance. Thus, the coating solution was prepared. [Composition of the coating solution]

| | |
|---|---|
| Dye | 1 part by weight |
| Polystyrene-acrylonitrile copolymer | 1 part by weight |
| Methyl ethyl ketone | 12 parts by weight |

This coating solution was coated on a polyethylene terephthalate film of film thickness of 6 μm by using a wire bar. Then, the article thus obtained was air-dried for two minutes at a temperature of 120° C. thus, an ink ribbon having a colored layer having a film thickness of 1 μm at the time of drying was obtained.

Embodiment 2

In this embodiment, polyester (Trade Name V-600, product of Toyobo Ltd., of Japan) is substituted for the polystyrene-acrylonitrile copolymer which was used as the binder high molecular substance in the coating solution in the embodiment 1. An ink ribbon was made up under the same condition as that of the embodiment 1 except for the above. [Composition of the coating solution]

| | |
|---|---|
| Dye | 1 part by weight |
| Polyester | 1 part by weight |
| Methyl ethyl ketone | 9 parts by weight |

The visible absorption spectrum of the ink ribbon thus obtained was measured. Thus, a measured result as shown in FIG. 1 was obtained.

From FIG. 1, it was confirmed that the dye ion-exchanged by tetradecil bromide ammonium salt as described above has satisfactory color hue.

Then, ink ribbons made up at the respective embodiments were caused to overlap with a photographic paper A mainly including polyester as the image receiving layer (Trade Name VPM-30ST, product of Sony Corporation of Japan), a photographic paper B including vinyl chloride-vinyl acetate copolymer as the image receiving layer, and a photographic paper C including butyral as the image receiving paper (Trade Name PVB-3000 K, product of Sekisui Kagaku Ltd., of Japan) to apply pressure of 20 g/cm$^2$ thereto for 30 seconds at a temperature of 100° C. to carry out transfer of dye.

As a result, even in the case where any ink ribbon was used, dye could be sufficiently transferred onto the image receiving layer of the photographic paper B or the photographic paper C. The optical density (reflection density) reached about 2. On the contrary, even in the case where any ink ribbon was used, dye was not transferred in the least to the photographic paper A mainly including polyester as the image receiving layer.

Then, the ink ribbon in the embodiment 2 was loaded into a ribbon cassette to implement monotone print onto the photographic paper B including vinyl chloride-vinyl acetate copolymer as the image receiving layer by using a color video printer (Trade Name CVP-G500, product of Sony Corporation of Japan).

As a result, an image having good hue and excellent tone was obtained, and its optical density came to 2.

In addition, in order to appraise light resistance of dye used in this embodiment, a coating solution in which the above-mentioned dye is uniformly dispersed into polyester resin (Trade Name UE-3600, product of Unichika Ltd., of Japan) was coated on a film by spin coat to make up an ink ribbon. Light of Xenon ark lamp was irradiated on the ink ribbon thus obtained to carry out acceleration test of light fading. It is to be noted that examination was similarly conducted in connection with an ink ribbon on the market (Trade Name Foron Blue, product of Sand Ltd.,) as a comparative example. This result was shown in FIG. 2.

Figure 2:
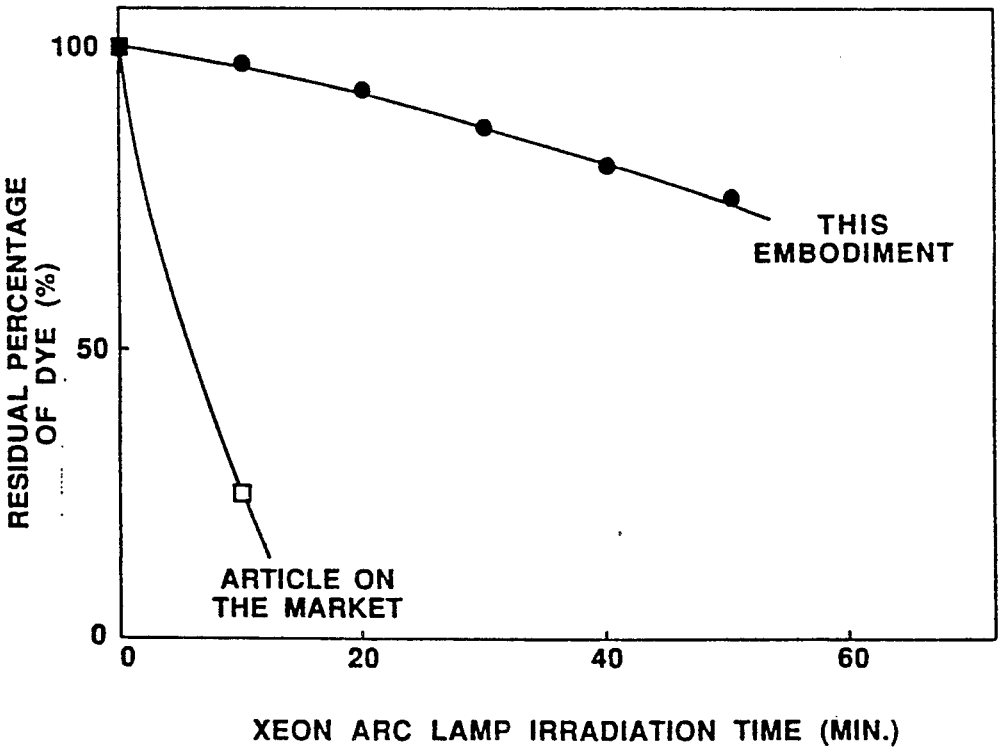
FIG. 2 is a characteristic diagram showing the relationship between the irradiation time of Xenon arc lamp and the dye residual percentage of an ink ribbon for thermal transfer to which this invention is applied and an ink ribbon on the market.

As shown in FIG. 2, it became clear that dye used in this embodiment has light fading remarkably more excellent than that of ink ribbon conventionally available on the market.

What is claimed is:

1. An ink ribbon for thermal transfer comprising: an anion dye and hydrophobic polymer in which the paired ion of the anion dye is exchanged for a hydrophobic organic cation, and wherein the anion dye is phthalocyanine and the content of the anion dye in the total quantity of said anion dye and said hydrophobic polymer is 10 to 90% by weight.

2. An ink ribbon for thermal transfer as set forth in claim 1, wherein said hydrophobic organic cation is at least one of aliphatic amine, aliphatic quaternary ammonium ion, aromatic quaternary ammonium ion, and hetereocyclic quaternary ammonium ion.

* * * * *